United States Patent [19]

Keyes et al.

[11] 4,058,474

[45] Nov. 15, 1977

[54] DRAIN CLEANING COMPOSITION

[75] Inventors: George B. Keyes, Cincinnati, Ohio; Justin J. Murtaugh, Guilford, Ind.

[73] Assignee: The Drackett Company, Cincinnati, Ohio

[21] Appl. No.: 630,840

[22] Filed: Nov. 10, 1975

Related U.S. Application Data

[63] Continuation-in-part of Ser. No. 477,891, June 10, 1974, abandoned.

[51] Int. Cl.[2] ..... C11D 7/06; C11D 7/12

[52] U.S. Cl. ..... 252/160; 252/156; 252/158; 252/159; 427/212

[58] Field of Search ..... 252/156, 160, 159, 140, 252/157, 158; 427/212, 222

[56] References Cited

U.S. PATENT DOCUMENTS

| | | | |
|---|---|---|---|
| 3,471,407 | 10/1969 | Spring | 252/157 |
| 3,630,936 | 12/1971 | Hill | 252/157 |
| 3,734,860 | 5/1973 | Bowen et al. | 252/158 |

*Primary Examiner*—Mayer Weinblatt

*Attorney, Agent, or Firm*—David J. Mugford; George A. Mentis; Samuel J. DuBoff

[57] ABSTRACT

This invention relates to drain cleaning compositions characterized by a pelletized form. Each pellet formed comprises aluminum; potassium or sodium nitrate; a binding material having a melting point of from about 37° C. to about 67° C. selected from the group consisting of polymers of polyethylene glycol, having a molecular weight of from about 3000 to about 20,000; polymers of ethylene oxide, having a molecular weight of from about 400,000 to about 2,000,000; aliphatic oxyethylated straight chain fatty alcohols having a molecular weight of about 260 to about 265 and containing about 80%, by weight, ethylene oxide; fatty acids having a carbon chain length of from about 10 to about 18 carbon atoms; alkali metal salts of gluconic acid; and mixtures thereof; at least about 1%, by weight, of an alkali metal hydroxide; and a sufficient amount of an additional compatible alkaline ingredient, whereby the total alkaline concentration present, expressed as sodium oxide, is at least about 11%, by weight.

6 Claims, No Drawings

DRAIN CLEANING COMPOSITION

This application is a continuation-in-part of our copending application, Ser. No. 477,891, filed June 10, 1974, now abandoned, for Drain Cleaning Compositions.

This invention relates generally to pelletized, drain cleaning compositions which develop heat upon contact with water when added to a drain, so as to remove materials clogging the drain.

More specifically, this invention relates to drain cleaning compositions in a pelletized form; wherein each pellet comprises aluminum, an alkali metal nitrate, an alkali metal hydroxide, and an organic polymeric binding material; wherein the binding material and this pelletized form provide drain cleaning compositions as effective as conventional drain cleaners, which require a much higher total alkaline concentration.

Drain cleaning compositions comprising an alakli metal hydroxide, aluminum and an inorganic nitrate, are well known. Frequently in the course of shipment of such compositions it develops that the relatively fine particulate materials segregate through the coarser particles and accumulate at the bottom of the container. The relatively heavy aluminum and nitrate also have a tendency to segregate out of the mixture. When such a drain cleaner composition is introduced into the residual water in a drain line trap or at a point removed from the site of an impedient, the caustic tends to dissolve rapidly, therefore dissipating a part of the heat generated before the composition reaches the site of the impediment. Furthermore, due to the segregation of the several particulate components of the compositions the reaction may or may not generate the desired maximum heat depending upon the manner in which the individual particulate components dissolve in the water and come in contact at proper predetermined concentrations. Accordingly, the segregation of the particular components and the premature solution and/or reaction of the caustic may limit the effectiveness of many of the presently known drain cleaner compositions.

Another problem arises in using caustic as a primary ingredient in a drain cleaner. Although caustic is desirable because of its high heat producing capability, the exothermic reaction, which takes place when caustic contacts water and other materials in the drain, does not produce the highest possible temperature in a short enough period of time to avoid dissipation of heat, which prevents the composition from cleaning most effectively. Thus, it has been recognized that by the addition of additives, such as aluminum and inorganic nitrates, the high degree of heat produced can be raised in a shorter period of time and maintained for a longer period of time. However, a problem arises if in combining these ingredients, a premature reaction occurs between the caustic, aluminum, and any water in the composition. This premature reaction will have the same effect as discussed above, i.e., dissipation of the heat producing capability of the caustic before the composition reaches the site of the impediment in the drain. Thus, the advantages of preparation of a caustic composition, where the possibility of premature reaction with water has been minimized, is obvious.

Another disadvantage of the alkali metal hydroxide drain cleaning compositions of the prior art is the necessity for a high alkali metal hydroxide concentration in order to have an effective drain cleaner. Because of the reactive nature of the alkali metal hydroxides, it is preferable to limit the alkali metal hydroxide concentration, while still providing a composition which can effectively remove the impediment in a drain.

In the past, various attempts have been made to eliminate these disadvantages in alkali metal hydroxide drain cleaning compositions.

Many compositions of the prior art which comprise predominantly alkali metal hydroxide, aluminum, and an inorganic nitrate depend upon a "fusing" of the ingredients so as to prevent segregation, such as the compositions disclosed in Racke (U.S. Pat. No. 3,077,455), Ford (U.S. Pat. No. 3,353,937), MacMahon (U.S. Pat. No. 2,676,153), and Graham (U.S. Pat. No. 3,344,078).

Adams (U.S. Pat. No. 2,010,800) discloses a cleaning composition wherein the alkali metal hydroxide, aluminum, and alkali metal nitrate are carried in a water-free crude mineral oil in order to avoid segregation and a premature reaction with moisture.

Preparation of a drain cleaning composition in a pelletized form has been recognized in the prior art. Spring (U.S. Pat. No. 3,471,407) and Adams (U.S. Pat. No. 3,584,098) teach cleaning compositions having 45–65% alkali metal hydroxide, where the compositions have been pelletized in the presence of water as a tackifying agent or binder.

Ladd (U.S. Pat. No. 1,928,226) teaches drain cleaning compositions, having predominantly alkali metal hydroxide and aluminum, compressed in a pill-making machine. Ladd further teaches that no binder is necessary to cause adhesion of the ingredients in these compositions.

Hill (U.S. Pat. No. 3,630,936) discloses drain cleaning compositions comprising 60–80% alkali metal hydroxide, aluminum, an inorganic nitrate, and an organic resinous binder, where the inorganic nitrate particles are bonded to the surface of the alkali metal hydroxide particles.

Although these references teach the pelletizing of a drain cleaning composition the use of a binder in the pelletizing process, they disclose only the utility of pelletizing to prevent segregation of ingredients and do not recognize the utility of a binding material in a pelletized composition to prevent the premature reaction of the ingredients with water; which allows the drain cleaning compositions of the present invention to be effective while having a minimum of only about 1%, by weight, of an alkali metal hydroxide.

In accordance with the present invention, drain cleaning compositions, characterized by a pelletized form, are provided wherein each pellet formed comprises aluminum; potassium or sodium nitrate; a binding material having a melting point of from about 37° C. to about 67° C. selected from the group consisting of polymers of polyethylene glycol, having a molecular weight of from about 3,000 to about 20,000; polymers of ethylene oxide, having a molecular weight of from about 400,000 to about 2,000,000; aliphatic oxyethylated straight chain fatty alcohols, having a molecular weight of about 260 to about 265 and containing about 80%, by weight, ethylene oxide; fatty acids, having a carbon chain length of from about 10 to about 18 carbon atoms; alkali metal salts of gluconic acid; or mixtures thereof; at least about 1 %, by weight, of an alkali metal hydroxide; and a sufficient amount of an additional compatible alkaline ingredient, whereby the total alkaline concentration present, expressed as sodium oxide, is at least about 11%, by weight.

The compositions of the present invention provide a drain cleaner in highly improved physical form wherein all the components of the product are substantially homogeneously distributed throughout the individual particles so as to avoid segregation, caking, and/or dusting thereof.

These compositions further provide a drain cleaner in highly improved physical form, namely, pelletized, whereby a delay of the reaction of the several components of the composition with each other and the water present at the site of a drain line impediment occurs before high temperatures are developed so as to provide a means of control over the reaction between the compositions and the impediment in the drain.

These compositions further provide a drain cleaner in a physical form which insures that a substantial portion of the homogeneous pellets reach the site of an impediment within a drain line, trap, and the like before any significant generation of heat takes place thereby increasing the effectiveness of the composition of the present invention in terms of the objective of its use, namely, breaking up of the impediment in the drain line.

These compositions further provide a drain cleaner, wherein each pellet has a substantially homogeneous formulation so as to include representative proportions of each and every component of the over-all composition utilized to form the pellets.

These compositions further provide a drain cleaner, wherein the induction period of the in situ reaction of the composition to clear a drain line of an impediment may be selectively controlled by the configuration and mesh size of the individual homogeneous pellets.

These compositions further provide a drain cleaning composition which does not tend to form a relatively insoluble cake of product adjacent the site of an impediment within a drain line.

The drain cleaning compositions of the present invention eliminate the problems and provide the advantages, discussed above. In utilizing a pelletized form of composition comprising a binding material, drain cleaning compositions are provided having a maximum heat of reduction upon reaching the impediment in a drain, which is derived from only a comparatively low concentration of alkali metal hydroxide, as further discussed below.

The alkali metal hydroxide particles utilized in the compositions of the present invention function as the primary source of heat for dissolving the impediment in a drain. All of the soluble alkali metal hydroxides such as sodium hydroxide, potassium hydroxide, lithium hydroxide, and the like, may be utilized in the present invention, either separately or in combination. However, sodium and potassium hydroxide are preferred with sodium hydroxide being most preferred due to its low cost and ready availability. These alkali metal hydroxide particles are generally ground or in prilled form with the prills being preferred. It has generally been found in conventional drain cleaning compositions that a high concentration (45–65%, by weight) or extremely high concentration (above 65%, by weight) of alkali metal hydroxide is needed to produce the heat of reaction necessary for dissolving effectively the impediment in a drain. With the compositions of the present invention, it has been found that the alkali metal hydroxide concentration can be reduced to less than 10%, if desired, and still provide an effective drain cleaner. Further, it has been found that the minimum concentration of alkali metal hydroxide which is effective in the compositions of this invention is about 1%, by weight; the maximum concentration not being limited, but preferred to be about 10%, by weight. The preferred amount in these compositions is from about 2% to about 10%, by weight.

An additional alkaline ingredient is necessary in the compositions of this invention in order to provide a minimum total alkaline concentration, expressed in terms of sodium oxide, of about 11%, by weight. Because of the reduction in alkali metal hydroxide concentration, a second source of alkaline material is necessary. However, the total alkaline content is still comparatively lower than the alkali metal hydroxide compositions of the prior art, while maintaining an equal heat of reaction. This additional alkaline ingredient may be any compatible alkaline ingredient, such as the alkali metal borates, silicates, phosphates, bicarbonates, carbonates, or mixtures thereof. The alkali metal borates include alkali metal meta- and tetra- borates, and hydrates thereof. The alkali metal carbonates include hydrates thereof. The alkali metal silicates*include the alkali metal meta- and ortho- silicates, and hydrates thereof. The alkali metal phosphates include alkali metal monobasic-, dibasic-, and tribasic- phosphates, meta- and pyro- phosphates, and hydrates thereof.

* represented byx($SiO_2$)/($M_2O$) where $x$ generally varies from 0.5 – 3.75 and M is an alkali metal It is noted that the carbonates, and especially, sodium or potassium carbonates, are most preferred. Although the alkali metal borates are not strongly basic, they can be used, provided the minimum alkalinity conditions (i.e. total composition alkalinity of greater than 11 weight % $Na_2O$) are met. The alkali metal silicates can be used, although there is a tendency for some interaction with the aluminum in the composition to form aluminum silicates. Also, the phosphates are useful although they have a slight tendency to form insoluble hydrates at high concentrations. Although bicarbonates tend to decompose at elevated temperatures (e.g. sodium bicarbonate begins to release $CO_2$ at 50° C), they can be used so long as precautions are taken during pelletizing of the ingredients to keep the temperatures below the decomposition temperature of these substances. It has been found that usually a minimum concentration of about 10%, by weight, of this additional alkaline ingredient is effective in the compositions of this invention, but this minimum is dependent on the alkali metal hydroxide concentration; if the alkali metal hydroxide concentration is increased, then the minimum concentration of this additional alkaline ingredient may be decreased, with the controlling factor being that the minimum total alkaline concentration necessary, expressed in terms of sodium oxide, be about 11%, by weight. The maximum amount of any such additional alkaline material is about 60%, by weight, and the preferred amount is from about 20% to about 30%, by weight. Given below are some typical alkalinity values for various alkaline ingredients expressed as % $Na_2O$.

| Chemical | Total Alkalinity/% $Na_2O$* |
|---|---|
| Sodium Hydroxide (NaOH) | 77.5 |
| Sodium Carbonate ($Na_2CO_3$) | 58.5 |
| Trisodium Phosphate ($Na_3PO_4$) | 37.8 |
| Sodium Bicarbonate ($NaHCO_3$) | 36.9 |
| Sodium Silicate ($Na_2O$ . 2 . $4SiO_2$) | 28.6 |
| Tetra sodium pyrophosphate ($Na_4P_2O_7$) | 23.2 |

*Titrated to the methyl orange end point

Aluminum, when it comes into contact with the alkali metal hydroxide, functions to generate the heat of reaction in the compositions of this invention. The aluminum may be present in granules, flakes, or powder, with the powder form being preferred. Aluminum should be present in a minimum concentration of about 1.5%, by weight, otherwise the reaction between aluminum and caustic is inadequate to produce the heat of reaction necessary to dissolve the impediment in the drain. The maximum concentration of aluminum should be about 12%, by weight. The preferred amount of aluminum in the compositions of this invention should be about 4% to about 6%, by weight.

Water-soluble inorganic nitrate particles, which are believed to act as an oxidizing agent to react with the hydrogen evolved by interaction between the aluminum and alkaline materials are provided in these drain cleaning compositions. Preferred are the alkali metal nitrates and most preferred is sodium nitrate. This ingredient should be present in a minimum concentration of about 15%, by weight, and a maximum concentration of about 51%, by weight. The preferred amount of this ingredient is from about 30% to about 42%, by weight.

As will be discussed further, a pelletized drain cleaning composition provides signficant advantages over a composition in powder form. However, inherent in the pelletizing of ingredients of a composition is the possibility of premature reaction of the ingredients, most importantly alkali metal hydroxide, with water, and aluminum.

Once this premature reaction begins, then the water which is formed as a by-product continues to propagate the reaction. The overall result is that the heat producing capability of the alkali metal hydroxide is then dissipated prematurely, so that when the composition is applied to an impediment in the drain, it will not effectively clean the drain. It is believed that this is the reason why the pelletized drain cleaning compositions in the prior art require a higher concentration of alkali metal hydroxide, i.e. because after this premature reaction uses up some of the available alkali metal hydroxide, enough must remain to be effective in dissolving the impediment in the drain.

Although it has been suggested that the moisture in raw materials used in these prior art pelletized compositions can be eliminated prior to pelletizing, it has been found that there is no effective means for eliminating the taking up of water by these hygroscopic materials so as to completely eliminate this reaction. Further, it has been found that the possible reaction and sensitivity to moisture and subsequent reaction therewith of these ingredients becomes more acute when subject to the heat and pressure of the pelletizing mill.

Thus, it has been found that the addition of a binding material prevents this premature reaction of ingredients in the drain cleaning compositions of the present invention, so that a minimum concentration of about 1% alkali metal hydroxide is effective in removing an impediment from a clogged drain.

Although this invention should not be limited to any particular theory, it is believed that the binder preferentially absorbs water so as to prevent the premature reaction between water and the ingredients of these drain cleaning compositions.

Various binding materials may be used in the compositions of the present invention, as long as the binding material chosen has the capacity to prevent this premature reaction of caustic with any water and aluminum present and permits an effective drain cleaning composition to be prepared utilizing only a minimum of about 1% alkali metal hydroxide.

Another important characteristic of the binding material is its melting point. The drain cleaning compositions of the present invention are pelletized so that a plurality of individual pellets are formed, each comprising the above-discussed ingredients. As discussed further below, the pellets which are formed are extruded from a die at a temperature just above the melting point of the binding material. As soon as the pellets are taken out of the die, they begin to cool and set up hard. If a binding material is chosen which has a melting point that is too low, then the extruded pellets remain soft and tacky after extrusion; as the pellets cool and set up, they stick to each other or expand from their compressed state and crumble or break up.

The binding materials useful in the compositions of the present invention have a melting point of from about 37° C. to about 67° C. It is recognized that if the process for producing the pelletized compositions of the present invention were altered so that the pellets were extruded at temperatures other than those described below, such as by the use of a cooling jacket to lower the temperature of the extruded pellets, then the melting point of the binding material utilized would logically have to be lowered, outside of the range specified above. In this instance, the important consideration would be the selection of a binding material, as described above, having a melting point just below the extrusion temperature so that a hard pellet could be formed.

Various materials may be utilized as binders in the compositions of the present invention; the solid aliphatic oxyethylated straight chain fatty alcohols, having a molecular weight of about 260 to about 265 and containing about 80%, by weight, ethylene oxide, such as the Plurafac nonionic surfactants made by Wyandotte Chemicals Corporation (e.g. typically Plurafac A-38 having a melting point of 45° C) which are further disclosed in U.S. Pat. No. 3,504,041; fatty acids having a chain length of from about 10 to about 18 carbon atoms; polymers of ethylene oxide having a molecular weight of from about 400,000 to about 2,000,000; alkali metal salts of gluconic acid selected from the group consisting of sodium gluconate (i.e. $NaC_6H_{11}O_7$)*; the polymers of polyethylene glycol, having a molecular weight of from about 3,000 to about 20,000; and mixtures thereof. Most preferred is a polymer of polyethylene glycol having an average molecular weight of 6000 and a melting point of 60°-65° C., which is available commercially under the name of "CARBOWAX 6000".

* potassium gluconate ($KC_6H_{11}O_7$), and sodium glucoheptonate ($NaC_7H_{13}O_8$)

This binding material may be present in a minimum amount of about 0.5% to a maximum amount of about 10%, by weight. The preferred amount of this material in the compositions of the present invention is from about 2% to about 6%, by weight.

The pelletized compositions of the present invention may also include in addition to the ingredients discussed above, optional catalytic agents, inert carriers, fillers, or other additives conventionally used in drain cleaning compositions.

For example, alkali metal chlorides, which function as fillers and provide additional pellet hardness, may be utilized in these compositions. Preferred are potassium and sodium chloride with sodium chloride being most preferred. This ingredient may be present in a maximum amount of about 48%, by weight, but the preferred amount of any such ingredient utilized is from about 11% to about 30%, by weight.

Additionally, an oil is preferred in the pelletized compositions of the present invention. An oil provides lubrication during the process for producing the pellets of these compositions and helps prevent premature reaction of the ingredients of these compositions.

Pelletizing of a composition generates heat in the pelletizing die, due to friction, and this heat is transferred to the pellet as it is extruded. In the preparation of the pelletized compositions of this invention, it has been found that the addition of an oil to the above-identified ingredients reduces the friction and heat generated in the die and allows the pellet to be extruded at a lower temperature just above the melting point of the binding material.

In pelletizing, where the possiblity of reaction of ingredients is increased because of the high pressures and temperatures generated, it is believed that the alkali metal hydroxide, aluminum, and any water which is present may react prematurely to release nascent hydrogen. This hydrogen further reacts with the inorganic nitrate present to reduce the nitrate until the nitrogen and hydrogen combine to yield ammonia fumes, which results in a composition that produces less effective pellets. It has been found that if the aluminum powder in these compositions is premixed with the oil, before mixing with the other ingredients, then this premature reaction is lessened or eliminated, resulting in improved stability of the pellets formed therefrom. It is believed that this hydrophobic coating of oil keeps the alkali metal hydroxide and any water present, which may be a dehydration product resulting from the heat and pressure of pelletizing, from reacting with the aluminum. Thus, it is evident that the binding material and the oil, work together to eliminate any premature reaction of the ingredients of these compositions, so that pellets of improved stability and effectiveness can be produced. Another attribute of the oil, which may be included in the pelletized compositions of this invention, it that when these pellets are added to a water-filled drain pipe, the oil floats off the surface of the pellet and up to the top of the water. At the same time, the pellet has begun to break up and the other ingredients have begun to dissolve. When these other ingredients have dissolved to a point where the alkali metal hydroxide and aluminum have begun to react, an oil layer has formed on the top of the water of sufficient thickness to prevent the resulting ammonia fumes from escaping. Thus, these fumes are trapped in the quiescent water layer above the reacting ingredients and below this oil film, so that maximum effectiveness of the reaction between the aluminum and alkali metal hydroxide may be utilized to dissolve the impediment in the drain.

The oils which may be useful, as described above, may include but are not limited to, mineral oils, motor oils, silicone oils, and vegetable oils in a concentration of up to about 10 weight %, and preferably about 2 to 10 weight %. Most preferred are the mineral oils with the most preferred mineral oil being one of low viscosity (approximately 68–75 Saybolt Universal Seconds at 100° F.), which is available commercially under the name "SUNFLEX-107". Briefly, "mineral oil" is a mixture of liquid hydrocarbons obtained from petroleum from which all unsaturated straight chain (aliphatic), heterocyclic (naphthenic) and aromatic hydrocarbons have been removed. They are composed entirely of saturated aliphatic and naphthenic hydrocarbons. They fall within the viscosity range of products commonly called "oils"; minimum and maximum viscosity of these oils ranges between 34 and 360 Saybolt Universal Seconds at 37.8° C (i.e. 100° F). Thus, useful mineral oils are Primol 185, 205, 325 and 355; Marcol 70, 80, 90, 100, 130 and 145; and Bayol 35, 50, 55, 70, 85 and 90 made by Exxon Corporation. White mineral oils made by the Sonneborn Chemical and Refining Corporation such as Gloria USP, Carnation and Blandol NF; Sunflex oils 107, 110, 115, 120, 125, 130 and 136 made by the Sun Oil Company.

With regard to silicone oils, it has been found to be most useful and preferred to use dimethylpolysiloxanes characterized by having flashpoints of not less than 500° F and having a viscosity of 40 to 60 centistokes at 25° C. These oils can, of course, be used in mixtures with mineral, vegetable or motor oils. Such siloxanes having viscosities substantially above 60 and up to 1000 centistokes could be used in the formula if methods other than pelletizing were used to compact the powders or if their viscosities were reduced by initially blending them with mineral, motor or vegetable oils. For silicone oils not having the preferred characteristics called for above, there is a tendency for flashing of the oil under pelletizing conditions.

The useful vegetable oils that can be used are those having a viscosity of between about 40 to 60 centipoises at 25° C, typical examples of which are given below:

| Vegetable Oils | Viscosity* at 25° C | Preferred Formulation Range Weight % |
|---|---|---|
| "Pope" Olive Oil | 60 Centipoise | 5–8 |
| "Arrowhead" Peanut Oil | 53 Centipoise | 5–8 |
| Safflower Oil | 42 Centipoise | 5–8 |
| "Heritage House" Soybean Oil | 50 Centipoise | 5–8 |
| "Mazola" Corn Oil | 50 Centipoise | 5–8 |
| "Archer" Linseed Oil | 45 Centipoise | 5–8 |

*Brookfield Viscometer, LV Model, Spindle No. 1, 60 RPM

Formulation levels of vegetable oils greater than 10% creates mixing and pelletizing problems. Too much lubrication results in soft and mushy pellets or prevents pellets from forming.

During the testing of these oils it was obvious that the stability of the vegetable oils did not match that of the mineral oils. Because the vegetable oils are organic acids (essentially palmitic, oleic and linoleic acids) they have a tendency to be saponified by alkaline materials present in the composition. During pelletizing of formulas using these oils the odor of the soaps formed would emit from the pellet mill. Therefore, while these vegetable oils can be used to make a drain cleaning formulation of the type described herein, they are not the preferred oil. While other vegetable oils not tested could also be used in the formula, it is felt that those listed above are the most practical and accessible.

Additionally, petroleum lubricating oils or motor oils used for example in automobiles are useful, having a viscosity range of about 100–500 centipoise, typical examples of which are given below:

| Petroleum Lubricating Oils | Viscosity* at 25° C | Preferred Formulation Range (%) |
|---|---|---|
| "Kar Kare" SAE 20 Motor Oil | 175 Centipoise | 5–8 |
| "Kar Kare" SAE 30 Motor Oil | 330 Centipoise | 5–8 |
| "Quaker State" SAE 40 HD | | 5–8 |
| 2 cycle Motor Oil | 225 Centipoise | 5–8 |

*Brookfield Viscometer, LV Model, Spindle No. 2, 60 RPM

As experienced with the vegetable oils, levels of petroleum lubricating oils above the 10% level did not mix or pelletize very well. Because of the higher viscosity of these oils they presented a little more of a mixing, or blending, problem than obtained with the use of vegetable or mineral oils. Like the vegetable oils, these lubricating oils can be used, but are not the preferred oil.

In a drain cleaner in a powder form, because of the previously discussed problem of segregation of ingredients, it is not easily ascertained what proportion of each ingredient is reacting with the clog in the drain pipe. Because the ingredients in a pelletized form of drain cleaning composition are maintained in a uniform distribution, it is possible to ascertain and control the chemical reaction taking place at the site of the impediment in the drain. Further, it is apparent that the size of the individual pellets comprising the drain cleaning compositions of the present invention, are controlled by the process of their manufacture. Thus, by controlling first the particle sizes of the ingredients in these drain cleaning compositions, and second, the size of the pellets being produced, then the rate of reaction of the individual ingredients and of the pellets upon being introduced into the drain can be controlled. For example, the larger sized pellets have a longer induction period before reaction when contacted with water and it has been found that production of pellets of varying sizes, rather than pellets of one size, provides an increased capability of the compositions of the present invention to maintain a heat of reaction for a longer period of time.

In this regard, a useful particle size distribution of each of the ingredients has been found to be the following:

| Ingredient | Particle Size Range of Ingredients* Passed Through Sieve | Retained On Sieve | Preferred Sizes Passed Through Sieve | Retained in Sieve |
|---|---|---|---|---|
| Aluminum | 16 | 325 | 25 | 70 |
| Nitrate | 4 | 325 | 30 | 200 |
| Additional Alkaline | 8 | 325 | 35 | 230 |
| Alkali Metal Chloride | 100 | 325 | 100 | 325 |
| Alkali Metal Hydroxide | 8 | 100 | 30 | 70 |
| Binder | 35 | 325 | 35 | 325 |

*U.S. Standard Sieve Size (Meshes/Inches)

By varying the size of pellets produced, it is then possible to selectively control this induction period so as to provide a more effective drain cleaning composition.

Chart I below illustrates the particle size distribution of the ingredients prior to pelletizing identified above in the drain cleaning compositions of the present invention, which were prepared by the method that follows for the following formulation:

| Ingredient | Weight Percent |
|---|---|
| NaOH | 9.50 |
| $Na_2CO_3$ | 28.00 |
| NaCl | 21.20 |
| CARBOWAX 6000 | 2.00 |
| Aluminum | 4.30 |
| $NaNO_3$ | 30.00 |
| Sunflex 107 mineral oil | 5.00 |

CHART I

| Ingredient | % Retained on Mesh +35 | +65 | +100 | +200 | −200 |
|---|---|---|---|---|---|
| NaOH | 88.22 | 11.15 | 1.52 | 0 | 0 |
| $Na_2CO_3$ | 7.64 | 19.2 | 26.71 | 11.5 | 35.67 |
| NaCl | 0.0 | 0.0 | 0.32 | 16.2 | 83.48 |
| CARBOWAX 6000 | 3.62 | 77.52 | 7.59 | 9.3 | 1.91 |
| Aluminum | 85.80 | 14.11 | 0 | 0 | 0 |
| $NaNO_3$ | 10.74 | 27.90 | 29.98 | 25.74 | 5.47 |
| All Ingredients | 13.50 | 76.80 | 3.30 | 5.30 | 1.10 |

Prior to pelletizing, except for the aluminum powder, sodium hydroxide, and the binder the ingredients, are ground in a hammer mill to a particle size between 710 and 40 microns. The aluminum powder and binder are received in a fine particle size and the sodium hydroxide is in prill form. It is preferred to have pellets having a size such that they pass through the openings of U.S. sieve screen mesh size 8 and are retained on a 20 mesh size.

A portion of the total concentration of mineral oil is used to pre-coat the aluminum powder; the amount used to get a complete uniform coating is approximately 20% of the total weight of the aluminum. This coating is achieved by mixing of all the oil with the aluminum in a slurry and then draining the excess oil off the coated aluminum.

To begin the process of producing the pelletized drain cleaning compositions of the present invention, the excess oil drained off the pre-coated aluminum is added to sodium carbonate and sodium nitrate while mixing in any conventional ribbon blender or planetary mixer. After thorough mixing, an essentially dry looking powder results, which does not easily dust. The binder and sodium chloride are slowly added while mixing continues. The pre-coated aluminum powder is added and mixed. As the aluminum disperses, the mixture takes on a grayish speckled appearance. The last addition to the mixture is the sodium hydroxide prills. Although it is not critical, the sodium hydroxide is added last so as to prevent its taking up of as little moisture as possible. The ingredients are then mixed for a sufficient length of time to insure uniform distribution.

The mixture is then transferred to the feed hopper of a pelletizer, such as the Model CL-3 Laboratory Pellet Mill, manufactured by the California Pellet Mill Company. The mixture is vibrated or conveyed by a feed hopper down a feed trough into a feed auger, which delivers it into the center of the pelletizer. Once inside the main housing of the pelletizer, the mixture is forced between the die and an eccentric wheel and consequently through the holes of the die with each successive revolution of the die, which causes it to be pelletized. Because of the pressure and heat generated in the die due to friction, the pellet is extruded from the die at a temperature just above the melting point of the binding material. As discussed previously, the pellet then cools and sets up hard and is ready for use.

In a preferred embodiment of the drain cleaning compositions of the present invention, a pelletized drain cleaning composition is provided wherein each pellet consists essentially of about 4% to 6% by weight of aluminum; said binding material is present from about 2% to about 6%, by weight; said alkali metal nitrate is present from about 30% to about 42%, by weight; said alkali metal hydroxide is present from about 2% to about 10%, by weight; and said alkaline ingredient is present from about 20% to about 30%, by weight. Preferably, the alkali metal hydroxide is sodium or potassium hydroxide or mixtures thereof.

Another preferred embodiment is one wherein said binding material is said polymer of polyethylene glycol; said alkali metal nitrate is sodium nitrate; said alkali metal hydroxide is sodium hydroxide; and said alkaline ingredient is sodium carbonate.

Still another preferred embodiment is one wherein the composition additionally contains up to 10%, by weight, of an oil selected from the group consisting of mineral oils having a viscosity range of about 34 to 360 Saybolt Universal Seconds at 100° F; silicone oils selected from the group consisting of dimethylpolysiloxanes characterized by having flash points of not less than about 500° F and having a viscosity range of 40 to 60 centistokes at 25° C; vegetable oils having a viscosity range of about 40 to 60 centipoises at 25° C; petroleum lubricating oils having a viscosity range of about 100 to 500 centipoises at 25° C; and mixtures thereof.

Still another preferred embodiment is one wherein the composition additionally contains a salt selected from the group consisting of potassium chloride, sodium chloride and mixtures thereof and said salt is present in an amount up to about 48%, by weight.

More preferably the composition consists essentially of an oil which is a mineral oil present from about 5% to 8%, by weight; said salt is present from about 11% to 30%, by weight; said aluminum is present from about 4% to about 6%, by weight; said binding material is present from about 2% to about 6%, by weight; said alkali metal nitrate is present from about 30% to about 42%, by weight; said alkali metal hydroxide is present from about 2% to about 10%, by weight; and said alkaline ingredient is present from about 20% to about 30%, by weight.

Still more preferably the composition consists essentially of 4.3%, by weight, of aluminum; 30%, by weight, of sodium nitrate; 28%, by weight, of sodium carbonate; 21.2%, by weight, of sodium chloride; 9.5%, by weight, of sodium hydroxide; 5%, by weight, of mineral oil having a viscosity range of about 68–75 Saybolt Universal Seconds at 100° F; and 2%, by weight, of polyethylene glycol having an average molecular weight of 6000 and a melting point of 60° C to 65° C.

The following compositions were prepared according to the method described above, however, the ingredients present were varied, so as to illustrate the effect of a binding material in the drain cleaning compositions of the present invention. The term "alkali metal" as used in the description of this invention is meant to include sodium, potassium, lithium, rubidium, and the like, and in the Examples that follow sodium compounds are generally exemplified as representative of this term merely because of the low cost and ready availability of such compounds.

EXAMPLE 1

A composition was prepared consisting of the following ingredients. This composition reacted in the pellet mill producing clouds of ammonia fumes and did not pelletize. It is believed that because this composition did not comprise a binding material, and because of the low level of oil, premature reaction of the ingredients took place so that this composition was not capable of being pelletized.

| Ingredients | % |
|---|---|
| Aluminum | 4.3 |
| Sodium Nitrate | 30.0 |
| Sodium Carbonate | 28.0 |
| Sodium Hydroxide | 9.5 |
| SUNFLEX-107 | 3.0 |
| Sodium Chloride | 25.2 |

EXAMPLE 2

A composition was prepared consisting of the following ingredients. This composition reacted in the pellet mill producing clouds of ammonia fumes and did not pelletize. Although this composition comprised a sufficient amount of oil, it is believed that because of the absence of a binding material, premature reaction of the ingredients took place so that this composition was not capable of being pelletized.

| Ingredients | % |
|---|---|
| Aluminum | 4.3 |
| Sodium Nitrate | 30.0 |
| Sodium Carbonate | 30.0 |
| Sodium Borate | 10.0 |
| Sodium Hydroxide | 9.5 |
| SUNFLEX-107 | 6.0 |
| Potassium Chloride | 10.2 |

EXAMPLE 3

A composition was prepared consisting of the following ingredients. This composition produced pellets which were stable and did not crumble.

| Ingredients | % |
|---|---|
| Aluminum | 4.3 |
| Sodium Nitrate | 30.0 |
| Sodium Carbonate | 28.0 |
| Sodium Hydroxide | 9.5 |
| SUNFLEX-107 | 3.0 |
| Sodium Chloride | 23.2 |
| CARBOWAX 6000 | 2.0 |

EXAMPLE 4

A composition was prepared consisting of the following ingredients. This composition produced pellets which were stable and did not crumble.

| Ingredients | % |
|---|---|
| Aluminum | 4.3 |
| Sodium Nitrate | 30.0 |
| Sodium Carbonate | 30.0 |
| Sodium Hydroxide | 9.5 |
| SUNFLEX-107 | 6.0 |
| Potassium Chloride | 8.2 |
| CARBOWAX 6000 | 2.0 |

-continued

| Ingredients | % |
|---|---|
| Sodium Borate | 10.0 |

EXAMPLE 5

A composition was prepared consisting of the following ingredients. Although this composition did not contain a binding material, pellets were produced. The pellets were slightly gray colored which indicates some reaction had taken place inside the pelletizer. Upon storage of the pellets, droplets of moisture were found on the inside of the storage bag and eventually the pellets softened and struck together.

| Ingredients | % |
|---|---|
| Aluminum | 4.3 |
| Sodium Nitrate | 30.0 |
| Sodium Carbonate | 30.0 |
| Sodium Borate | 10.0 |
| Sodium Hydroxide | 2.0 |
| SUNFLEX-107 | 6.0 |
| Potassium Chloride | 17.7 |

EXAMPLE 6

A composition was prepared consisting of the following ingredients. As is evident, this composition is similar to the composition of Example 5, except for the inclusion of a binding material, CARBOWAX 6000. The pellets from this composition were white and did not soften upon storage.

| Ingredients | % |
|---|---|
| Aluminum | 4.3 |
| Sodium Nitrate | 30.0 |
| Sodium Carbonate | 30.0 |
| Sodium Borate | 10.0 |
| Sodium Hydroxide | 2.0 |
| SUNFLEX-107 | 6.0 |
| Potassium Chloride | 15.7 |
| CARBOWAX 6000 | 2.0 |

It is readily apparent from Examples 1–6 above, that the presence of a sufficient amount of a binding material allows a pelletized form of drain cleaning composition to be prepared.

In order to determine the effectiveness of the pelletized drain cleaning compositions of the present invention, compositions, which were pelletized according to the method described above, were placed in the clogged drain. First, the drain was clogged with the following materials:

1 gram hemp rope (¼ inch)
4 grams coffee grounds
15 grams beef fat (melted)

This mixture was allowed to solidify at which time 50 ml. of water was added. Next, 18 g. of pellets of each of the following compositions was then added to the water and clog in the drain and allowed to react with the clog. In the Examples 7–10 below, in approximately 3½ to 4½ minutes, a maximum temperature in the range of 94° C. to 100° C. was reached and the clog in the drain was removed.

EXAMPLE 7

| Ingredient | Ingredient (%) |
|---|---|
| Sodium Hydroxide | 9.50 |
| Sodium Carbonate | 28.00 |

EXAMPLE 7-continued

| Ingredient | Ingredient (%) |
|---|---|
| Sodium Nitrate | 30.00 |
| Aluminum | 8.15 |
| Sodium Chloride | 22.35 |
| CARBOWAX 6000 | 2.00 |

EXAMPLE 8

| Ingredient | Ingredient (%) |
|---|---|
| Sodium Hydroxide | 9.50 |
| Sodium Carbonate | 28.00 |
| Sodium Nitrate | 30.00 |
| Aluminum | 11.88 |
| Sodium Chloride | 18.62 |
| CARBOWAX 6000 | 2.00 |

EXAMPLE 9

| Ingredient | Ingredient (%) |
|---|---|
| Sodium Hydroxide | 1.00 |
| Sodium Carbonate | 25.00 |
| Sodium Nitrate | 30.00 |
| Aluminum | 4.30 |
| Sodium Chloride | 37.70 |
| CARBOWAX 6000 | 2.00 |

EXAMPLE 10

| Ingredient | Ingredient (%) |
|---|---|
| Sodium Hydroxide | 1.00 |
| Sodium Carbonate | 20.00 |
| Sodium Nitrate | 30.00 |
| Aluminum | 4.30 |
| Sodium Chloride | 42.70 |
| CARBOWAX 6000 | 2.00 |

It was additionally observed that when pellets in the shape of ⅛ inch diameter by ¼ inch long cylinders were placed in a column of water, such as found in a drain pipe, these pellets fell to the bottom in a random fashion so that voids were created between each pellet. As the pellets began to dissolve, the heat of solution created convection currents in the water. This heated water helped diffuse the solubilized and ionized alkaline materials and as it flowed through these voids, increased the rate of solubilization. Subsequently, the heat around each pellet was increased until the aluminum-alkali reaction was activated. It is believed that when these pellets fall through standing water in a drain trap, they collect at the bottom before they begin to react. Pouring of the powder form of this same composition into the drain causes much of the ingredients to dissolve as they fall, rather than at the bottom of the drain trap. These powders, some of which are highly water soluble, dissolve in the upper quiescent layer of water. Thus, the alkalinity which is present on the bottom of the trap to react with the aluminum is less than is necessary and the heat of reaction generated does not produce an effective drain cleaning composition.

Further, the presence of oil, compactness of the pellet, and the low concentration of an alkali metal hydroxide, allow a time delay in reaction of the pellet on contact with water. The oil, because of its hydrophobic nature, slows solubilization of ingredients. The compactness of the pellet reduces the surface area of the material available to solubilize and the low alkali metal hydroxide concentration takes a longer time to reach that point where it will react with the aluminum which is present. Therefore, although the pelletized drain cleaning compositions of the present invention reach the same maximum reaction temperature as conventional powder form drain cleaners, this maximum reaction temperature is delayed so as to provide a degree of controlled activity.

Inasmuch as the present invention is subject to many variations, modifications, and changes in detail, it is intended that all matter above described or shown in the examples be interpreted as illustrative and not in a limiting sense.

It was observed that the formulation in Example 11 produced a flash fire within the pelletizing machine during processing resulting in a charred mass due to the low flash point of the silicone oil.

EXAMPLE 11

| Ingredient | % |
|---|---|
| Sodium hydroxide | 9.5 |
| sodium nitrate | 30.0 |
| sodium carbonate | 28.0 |
| sodium chloride | 23.2 |
| Aluminum powder | 4.3 |
| CARBOWAX 6000 | 2.0 |
| Dow Corning 530 Silicone Fluid* | 3.0 |
| | 100.0 |

*80 centistokes at 25° C.; flash point of 100° F

The following pelletized drain cleaning compositions having a particle size of 8 to 20 U.S. sieve mesh were prepared in accordance with the procedure previously described.

EXAMPLE 12

| Ingredient | % |
|---|---|
| Sodium hydroxide | 9.5 |
| sodium nitrate | 30.0 |
| sodium carbonate | 28.0 |
| sodium chloride | 21.2 |
| Aluminum powder | 4.3 |
| CARBOWAX 6000 | 2.0 |
| General Electric Silicone Fluid SF-96* | 5.0 |
| | 100.0 |

*50 centistokes at 25° C; flash point of 500° F

EXAMPLE 13

| Ingredient | % |
|---|---|
| Sodium hydroxide | 9.5 |
| Sodium nitrate | 30.0 |
| Sodium carbonate | 28.0 |
| Sodium chloride | 16.2 |
| Aluminum powder | 4.3 |
| CARBOWAX 6000 | 2.0 |
| "Pope" Olive Oil | 10.0 |
| | 100.0 |

EXAMPLE 14

| Ingredient | % |
|---|---|
| Sodium hydroxide | 9.5 |
| Sodium nitrate | 30.0 |
| Sodium carbonate | 28.0 |
| Sodium chloride | 23.2 |
| Aluminum powder | 4.3 |
| CARBOWAX 6000 | 2.0 |
| "Pope" Olive Oil | 3.0 |
| | 100.0 |

EXAMPLE 15

| Ingredient | % |
|---|---|
| Sodium hydroxide | 9.5 |
| Sodium nitrate | 30.0 |
| Sodium carbonate | 28.0 |
| Sodium chloride | 23.2 |
| Aluminum powder | 4.3 |
| CARBOWAX 6000 | 2.0 |
| "Arrowhead" Peanut Oil | 3.0 |
| | 100.0 |

EXAMPLE 16

| Ingredient | % |
|---|---|
| Sodium hydroxide | 9.5 |
| Sodium nitrate | 30.0 |
| Sodium carbonate | 28.0 |
| Sodium chloride | 16.2 |
| Aluminum powder | 4.3 |
| CARBOWAX 6000 | 2.0 |
| "Arrowhead" Peanut Oil | 10.0 |
| | 100.0 |

EXAMPLE 17

| Ingredient | % |
|---|---|
| Sodium hydroxide | 9.5 |
| Sodium nitrate | 30.0 |
| Sodium carbonate | 28.0 |
| Sodium chloride | 23.2 |
| Aluminum powder | 4.3 |
| CARBOWAX 6000 | 2.0 |
| "Arrowhead" Safflower Oil | 3.0 |
| | 100.0 |

EXAMPLE 18

| Ingredient | % |
|---|---|
| Sodium hydroxide | 9.5 |
| Sodium nitrate | 30.0 |
| Sodium carbonate | 28.0 |
| Sodium chloride | 16.2 |
| Aluminum powder | 4.3 |
| CARBOWAX 6000 | 2.0 |
| "Arrowhead" Safflower Oil | 10.0 |
| | 100.0 |

EXAMPLE 19

| Ingredient | % |
|---|---|
| Sodium hydroxide | 9.5 |
| Sodium nitrate | 30.0 |
| Sodium carbonate | 28.0 |
| Sodium chloride | 23.2 |
| Aluminum powder | 4.3 |
| CARBOWAX 6000 | 2.0 |
| "Heritage House" Soybean Oil | 3.0 |
| | 100.0 |

EXAMPLE 20

| Ingredient | % |
|---|---|
| Sodium hydroxide | 9.5 |
| Sodium nitrate | 30.0 |
| Sodium carbonate | 28.0 |
| Sodium chloride | 18.2 |
| Aluminum powder | 4.3 |
| CARBOWAX 6000 | 2.0 |
| "Heritage House" Soybean Oil | 8.0 |
| | 100.0 |

EXAMPLE 21

| Ingredient | % |
|---|---|
| Sodium hydroxide | 9.5 |
| Sodium nitrate | 30.0 |
| Sodium carbonate | 28.0 |
| Sodium chloride | 16.2 |
| Aluminum powder | 4.3 |
| CARBOWAX 6000 | 2.0 |
| "Mazola" Corn Oil | 10.0 |
| | 100.0 |

EXAMPLE 22

| Ingredient | % |
|---|---|
| Sodium hydroxide | 9.5 |
| Sodium nitrate | 30.0 |
| Sodium carbonate | 28.0 |
| Sodium chloride | 13.2 |
| Aluminum powder | 4.3 |
| CARBOWAX 6000 | 2.0 |

EXAMPLE 22-continued

| Ingredient | % |
|---|---|
| "Mazola" Corn Oil | 13.0 |
| | 100.0 |

EXAMPLE 23

| Ingredient | % |
|---|---|
| Sodium hydroxide | 9.5 |
| Sodium nitrate | 30.0 |
| Sodium carbonate | 28.0 |
| Sodium chloride | 23.2 |
| Aluminum powder | 4.3 |
| CARBOWAX 6000 | 2.0 |
| "Archer" Linseed Oil | 3.0 |
| | 100.0 |

EXAMPLE 24

| Ingredient | % |
|---|---|
| Sodium hydroxide | 9.5 |
| Sodium nitrate | 30.0 |
| Sodium carbonate | 28.0 |
| Sodium chloride | 16.2 |
| Aluminum powder | 4.3 |
| CARBOWAX 6000 | 2.0 |
| "Archer" Linseed Oil | 10.0 |
| | 100.0 |

EXAMPLE 25

| Ingredient | % |
|---|---|
| Sodium hydroxide | 9.5 |
| Sodium nitrate | 30.0 |
| Sodium carbonate | 28.0 |
| Sodium chloride | 23.2 |
| Aluminum powder | 4.3 |
| CARBOWAX 6000 | 2.0 |
| "Kar Kare" SAE 20 Motor Oil | 3.0 |
| | 100.0 |

EXAMPLE 26

| Ingredient | % |
|---|---|
| Sodium hydroxide | 9.5 |
| Sodium nitrate | 30.0 |
| Sodium carbonate | 28.0 |
| Sodium chloride | 16.2 |
| Aluminum powder | 4.3 |
| CARBOWAX 6000 | 2.0 |
| "Kar Kare" SAE 20 Motor Oil | 10.0 |
| | 100.0 |

EXAMPLE 27

| Ingredient | % |
|---|---|
| Sodium hydroxide | 9.5 |
| Sodium nitrate | 30.0 |
| Sodium carbonate | 28.0 |
| Sodium chloride | 23.2 |
| Aluminum powder | 4.3 |
| CARBOWAX 6000 | 2.0 |
| "Kar Kare" SAE 30 Motor Oil | 3.0 |
| | 100.0 |

EXAMPLE 28

| Ingredient | % |
|---|---|
| Sodium hydroxide | 9.5 |
| Sodium nitrate | 30.0 |
| Sodium carbonate | 28.0 |
| Sodium chloride | 16.2 |
| Aluminum powder | 4.3 |
| CARBOWAX 6000 | 2.0 |
| "Kar Kare" SAE 30 Motor Oil | 10.0 |
| | 100.0 |

EXAMPLE 29

| Ingredient | % |
|---|---|
| Sodium hydroxide | 9.5 |
| Sodium nitrate | 30.0 |
| Sodium carbonate | 28.0 |
| Sodium chloride | 18.2 |
| Aluminum powder | 4.3 |
| CARBOWAX 6000 | 2.0 |
| "Quaker State" SAE 40 Motor Oil | 8.0 |
| | 100.0 |

EXAMPLE 30

| Ingredient | % |
|---|---|
| Sodium hydroxide | 9.5 |
| Sodium nitrate | 30.0 |
| Sodium carbonate | 28.0 |
| Sodium chloride | 23.2 |
| Aluminum powder | 4.3 |
| CARBOWAX 6000 | 2.0 |
| "Quaker State" SAE 40 Motor Oil | 3.0 |
| | 100.0 |

EXAMPLE 31

| Ingredient | % |
|---|---|
| Sodium hydroxide | 2.0 |
| Sodium nitrate | 20.0 |
| Potassium carbonate | 40.7 |
| Trisodium phosphate | 10.0 |
| Aluminum powder | 4.3 |
| CARBOWAX 6000 | 4.0 |
| SUNFLEX 107 Mineral Oil | 9.0 |
| Sodium gluconate | 10.0 |
| | 100.0 |

EXAMPLE 32

| Ingredient | % |
|---|---|
| Sodium hydroxide | 2.0 |
| Sodium nitrate | 19.0 |
| Potassium carbonate | 37.7 |
| Trisodium phosphate | 8.0 |
| Aluminum powder | 4.3 |
| CARBOWAX 6000 | 4.0 |
| SUNFLEX 107 Mineral Oil | 20.0 |
| Sodium gluconate | 5.0 |
| | 100.0 |

The composition of Example 32 was difficult to pelletize in that the mixture tended to be doughy, rather than a dry particulate mixture, due to the relatively high concentration of oil present (i.e. 20%).

EXAMPLE 33

| Ingredient | % |
|---|---|
| Sodium hydroxide | 2.0 |
| Sodium nitrate | 20.0 |
| Potassium carbonate | 50.7 |
| Sodium gluconate | 10.0 |
| Aluminum powder | 4.3 |
| CARBOWAX 6000 | 4.0 |
| SUNFLEX 107 Mineral Oil | 9.0 |
| | 100.0 |

EXAMPLE 34

| Ingredient | % |
|---|---|
| Sodium hydroxide | 2.0 |
| Sodium nitrate | 20.0 |
| Potassium carbonate | 40.7 |
| Sodium gluconate | 10.0 |
| Aluminum powder | 4.3 |
| CARBOWAX 6000 | 4.0 |
| SUNFLEX 107 Mineral Oil | 9.0 |
| Trisodium phosphate | 10.0 |
| | 100.0 |

EXAMPLE 35

| Ingredient | % |
|---|---|
| Sodium hydroxide | 2.0 |
| Sodium nitrate | 20.0 |
| Sodium carbonate | 55.0 |
| Potassium chloride | 4.7 |
| Aluminum powder | 4.3 |
| CARBOWAX 6000 | 4.0 |
| SUNFLEX 107 Mineral Oil | 5.0 |
| Sodium gluconate | 5.0 |
| | 100.0 |

EXAMPLE 36

| Ingredient | % |
|---|---|
| Sodium nitrate | 20.0 |
| Trisodium phosphate | 35.0 |
| Potassium chloride | 27.5 |
| Aluminum powder | 4.5 |
| CARBOWAX 6000 | 2.0 |
| SUNFLEX 107 Mineral Oil | 11.0 |
| | 100.0 |

EXAMPLE 37

| Ingredient | % |
|---|---|
| Trisodium phosphate | 35.0 |
| Sodium nitrate | 20.0 |
| Potassium chloride | 28.8 |
| Aluminum powder | 4.2 |
| CARBOWAX 6000 | 3.0 |
| SUNFLEX 107 Mineral Oil | 9.0 |
| | 100.0 |

EXAMPLE 38

| Ingredient | % |
|---|---|
| Sodium hydroxide | 9.5 |
| Sodium nitrate | 30.0 |
| Sodium carbonate | 17.7 |
| Sodium borate | 30.0 |
| Aluminum powder | 4.8 |
| CARBOWAX 6000 | 2.0 |
| SUNFLEX 107 Mineral Oil | 6.0 |
| | 100.0 |

EXAMPLE 39

| Ingredient | % |
|---|---|
| Sodium hydroxide | 9.5 |
| Sodium nitrate | 30.0 |
| Sodium carbonate | 18.2 |
| Potassium chloride | 20.0 |
| Aluminum powder | 4.3 |
| CARBOWAX 6000 | 2.0 |
| SUNFLEX 107 Mineral Oil | 6.0 |
| Sodium borate | 10.0 |
| | 100.0 |

EXAMPLE 40

| Ingredient | % |
|---|---|
| Sodium gluconate | 10.0 |
| Sodium hydroxide | 2.0 |
| Sodium nitrate | 20.0 |
| Sodium carbonate | 40.0 |
| Potassium chloride | 4.5 |
| Aluminum powder | 4.5 |
| CARBOWAX 6000 | 4.0 |
| Trisodium phosphate | 10.0 |
| SUNFLEX 107 Mineral Oil | 5.0 |
| | 100.0 |

EXAMPLE 41

| Ingredient | % |
|---|---|
| Sodium hydroxide | 2.0 |
| Sodium nitrate | 20.0 |
| Sodium silicate | 20.0 |
| Potassium chloride | 4.5 |

EXAMPLE 41-continued

| Ingredient | % |
|---|---|
| Aluminum powder | 4.5 |
| CARBOWAX 6000 | 4.0 |
| Sodium gluconate | 10.0 |
| Sodium carbonate | 30.0 |
| SUNFLEX 107 Mineral Oil | 5.0 |
| | 100.0 |

The composition of Example 41 tends to produce a moderate amount of precipitate (probably aluminum silicate) during use as a drain cleaner in aqueous solutions.

What is claimed is:

1. A pelletized drain cleaning composition wherein each pellet of said composition consists essentially of:

1. 1.5 to 12 weight percent aluminum;
2. 15 to 51 weight percent of an alkali metal nitrate selected from the group consisting of potassium nitrate, sodium nitrate and mixtures thereof;
3. 0.5 to 10 weight percent of a binding material having a melting point of from about 37° C. to about 67° C. selected from the group consisting of polymers of polyethylene glycol, having a molecular weight of from about 3000 to about 20,000; polymers of ethylene oxide, having a molecular weight of from about 400,000 to about 2,000,000; hydrocarbon oxyethylated straight chain fatty alcohols, having a molecular weight of about 260 to about 265 and containing about 80%, by weight, ethylene oxide; fatty acids, having a carbon chain length of from about 10 to about 18 carbon atoms; alkali metal salts of gluconic acid selected from the group consisting of sodium gluconate, potassium gluconate and sodium glucoheptonate; and mixtures thereof;
4. 1 to 10 percent of an alkali metal hydroxide;
5. 10 to 60 weight percent of an additional compatible alkaline ingredient selected from the group consisting of alkali metal borates, alkali metal silicates, alkali metal bicarbonates, alkali metal carbonates, alkali metal phosphates and mixtures thereof, whereby the total alkaline concentration present, expressed as sodium oxide, is at least about 11%, by weight; wherein said alkali metal borates are alkali metal meta-, tetra-borates, or hydrates thereof;

said alkali metal silicates are alkali metal meta-, ortho-silicates, or hydrates thereof having the formula $x(SiO_2)(M_2O)$, where x varies from 0.5 to 3.75 and M is an alkali metal; and said alkali metal phosphates are alkali metal monobasic-, dibasic-, tribasic-, meta-, pyrophosphates, or hydrates thereof;
6. up to about 10 weight percent of an oil selected from the group consisting of mineral oils having a viscosity range of about 34 to 360 Saybolt Universal Seconds at 100° F; silicone oils selected from the group consisting of dimethylpolysiloxanes having flash points of not less than about 500° F and having a viscosity range of about 40 to 60 centistokes at 25° C; vegetable oils having a viscosity range of about 40 to 60 centipoises at 25° C; petroleum lubricating oils having a viscosity range of about 100 to 500 centipoises at 25° C; and mixtures thereof; wherein the amount of oil present is sufficient to coat the aluminum; and 7. a salt selected from the group consisting of potassium chloride, sodium chloride and mixtures thereof and said salt is present in an amount up to about 48%, by weight; wherein said composition is prepared by the method consisting essentially of:
   a. reducing the particle size of all of the ingredients to a size between 40 and 710 microns;
   b. coating the aluminum particles with the oil; and draining off the excess oil
   c. adding the excess oil, the alkali metal nitrate, alkaline ingredient, the binder material, and the salt, if any, to the coated aluminum particles of (b) and mixing the ingredients;
   d. adding the alkali metal hydroxide particles to the resulting mixture of (c) and mixing the ingredients;
   e. pelletizing the resulting mixture of (d) at a temperature just above the melting point of the binding material; and f. cooling the resulting pellets obtained from
   e. said pellets having a size such that they pass through the openings of a U.S. sieve screen having a mesh size of 8 and are retained on a U.S. sieve screen having a mesh size of 20.

2. A composition according to claim 1 wherein said alkali metal hydroxide is selected from the group consisting of potassium hydroxide, sodium hydroxide and mixtures thereof.

3. A composition according to claim 1 wherein said aluminum is present from about 4% to about 6%, by weight; said binding material is present from about 2% to about 6%, by weight; said alkali metal nitrate is present from about 30% to about 42%, by weight; said alkali metal hydroxide is present from about 2% to about 10%, by weight; and said alkaline ingredient is present from about 20% to about 30%, by weight.

4. A composition according to claim 3 wherein said binding material is said polymer of polyethylene glycol; said alkali metal nitrate is sodium nitrate; said alkali metal hydroxide is sodium hydroxide; and said alkaline ingredient is sodium carbonate.

5. A composition according to claim 1 wherein said oil is a mineral oil present from about 5% to 8%, by weight; said salt is present from about 11% to 30%, by weight; said aluminum is present from about 4% to about 6%, by weight, said binding material is present from about 2% to about 6%, by weight; said alkali metal nitrate is present from about 30% to about 42%, by weight; said alkali metal hydroxide is present from about 2% to about 10%, by weight; and said alkaline ingredient is present from about 20% to about 30%, by weight.

6. A composition according to claim 5 wherein said composition consists essentially of 4.3%, by weight, of aluminum; 30%, by weight, of sodium nitrate; 28%, by weight, of sodium carbonate; 21.2%, by weight, of sodium chloride; 9.5%, by weight, of sodium hydroxide; 5%, by weight, of mineral oil having a viscosity range of about 68–75 Saybolt Universal Seconds at 100° F; and 2%, by weight, of polyethylene glycol having an average molecular weight of 6000 and a melting point of 60° C to 65° C.

* * * * *